United States Patent [19]

Murayama

[11] 4,425,896

[45] Jan. 17, 1984

[54] FUEL INJECTION ADVANCE APPARATUS

[75] Inventor: Fumiaki Murayama, Kariya, Japan

[73] Assignee: Nippondenso Co., Ltd., Kariya, Japan

[21] Appl. No.: 358,325

[22] Filed: Mar. 15, 1982

[30] Foreign Application Priority Data

Mar. 31, 1981 [JP] Japan ..... 56-47087[U]

[51] Int. Cl.[3] ..... F02M 59/20

[52] U.S. Cl. ..... 123/501; 123/502

[58] Field of Search ..... 123/501, 502; 464/2, 464/6

[56] References Cited

U.S. PATENT DOCUMENTS

| | | | |
|---|---|---|---|
| 2,829,630 | 4/1958 | Ziesche et al. | 123/501 |
| 3,683,879 | 8/1972 | Timms | 123/501 |
| 4,132,202 | 1/1979 | Nakayama et al. | 123/501 |
| 4,304,205 | 12/1981 | Bauer et al. | 123/501 |
| 4,332,227 | 6/1982 | Bauer et al. | 123/501 |
| 4,354,473 | 10/1982 | Geyer et al. | 123/501 |

*Primary Examiner*—Ira S. Lazarus
*Assistant Examiner*—Magdalen Moy
*Attorney, Agent, or Firm*—Kenyon & Kenyon

[57] ABSTRACT

A fuel injection advance apparatus comprising a rotational hub connected to a cam shaft of a fuel injection device, an engine-driven rotatable casing which is supported on the hub, eccentric cam assemblies located between the hub and the casing to adjust a relative angular position therebetween, a hydraulic piston having an inclined surface which is connected to an engine-driven pump, and slides having inclined surfaces corresponding to and contacting the inclined surface of the piston so that the axial movement of the piston is converted to the radial movements of the slides, said slides being connected to the eccentric pins.

10 Claims, 6 Drawing Figures

Fig. 2
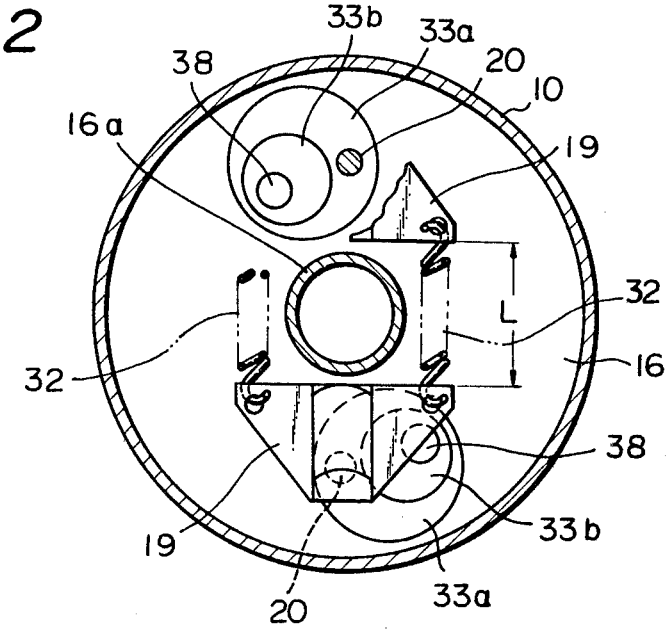
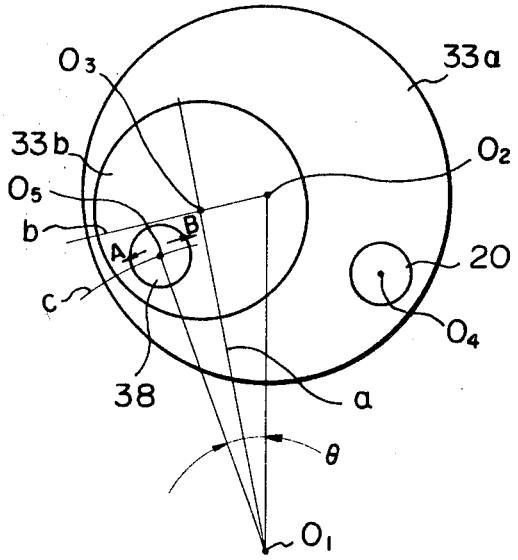
Fig. 3

FUEL INJECTION ADVANCE APPARATUS

BACKGROUND OF THE INVENTION

This invention relates to an apparatus for controlling the injection of fuel in an internal combustion engine, such as a diesel engine.

It is necessary to control the initiation of injection of fuel in accordance with various engine conditions, such as the rate of rotation and the temperature of the engine, or atmospheric parameters, such as the atmospheric temperature, so as to obtain an optimum engine performance. There is known a pressure-operated fuel injection control (advance) apparatus which operates in response to electrical signals from sensors which are known per se and which detect various parameters, such as the engine temperature or the number of revolutions, as mentioned above. The pressure-operated fuel injection control apparatus is connected to a pressure source. Usually, the pressure source is an oil delivery pump or a vacuum pump.

There are two types of oil pumps or vacuum pumps: the engine-driven type and the electrical motor-driven type. In an engine-driven pump driven by an internal combustion engine, the pump cannot produce a pressure sufficient to actuate the fuel injection advance apparatus when the engine is started, so that fuel injection cannot be advanced. However, it is necessary, as is well known, to advance the fuel injection when the engine is started since the engine temperature is low and since the combustion rate of the fuel tends to decrease.

On the other hand, this problem can be solved by a motor-driven pump. However, in the case of a motor-driven pump, a motor and a pump which is driven by the motor, which are not usually provided in an automobile, must be additionally provided. Furthermore, a motor-driven pump is usually rather expensive in comparison with an engine-driven pump.

OBJECT OF THE INVENTION

The primary object of the present invention is, therefore, to provide a pressure-operated fuel injection control apparatus having an engine-driven hydraulic pump which can ensure a desired advance of an injection of the fuel even at the time the engine is started.

BRIEF DESCRIPTION OF THE DRAWINGS

The invention will be discussed in detail below, with reference to the accompanying drawings, in which:

FIG. 2 is a sectional view taken along the line II—II in FIG. 1;

FIG. 3 is an enlarged schematic view showing the movement of an eccentric cam provided in the apparatus shown in FIG. 1;

DETAILED DESCRIPTION

Figure 1:
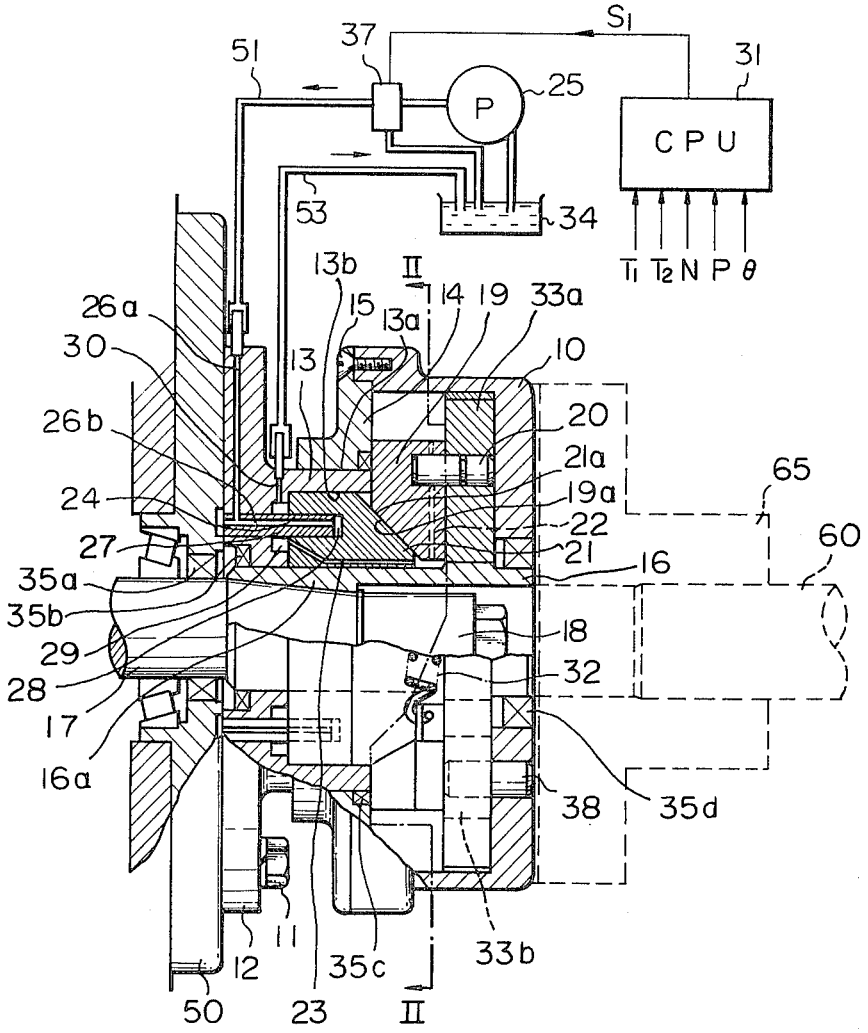
FIG. 1 is a longitudinal sectional view of a fuel injection control apparatus, according to the present invention.

In FIGS. 1 and 2, a rotatable flange 10 of a fuel injection control apparatus is connected to a drive shaft 60 of an engine (not shown) by means of a clutch 65 so that the flange 10 can rotate together with an synchronously with the engine, i.e. the drive shaft 60. The flange 10 is secured to a cover 14 by means of fastening bolts 15 so that the flange 10 forms, together with the cover 14, a casing of the control, (or advance) apparatus. The cover 14 rotates on an outer periphery 13*a* of a cylindrical sleeve 13 of a stationary flange 12 which is connected to a fuel injection pump 50 (driven side) or an immovable part of the engine by means of bolts 11 (only one of which is illustrated), while keeping in sliding contact with the outer periphery 13*a*. A rotation hub 16 on the driven side is incorporated into the rotatable flange 10 and is rigidly connected to a cam shaft 17 of the fuel injection pump 50 by means of a cap nut 18.

The hub 16 has two pairs of eccentric cam assemblies, each pair having a large eccentric cam 33*a* and a small eccentric cam 33*b*. A pair of slides 19 have eccentric pins 20 which rotatably support the first, i.e. the large eccentric cams 33*a*, of the eccentric cam assemblies, respectively. The slides 19 have inclined cam surfaces 19*a* which are always in contact with a corresponding inclined surface (conical surface) 21*a* of an annular piston 21 which axially slides between a boss 16*a* of the hub 16 and an inner surface 13*b* of the sleeve 13. The second, i.e. the small eccentric cams 33*b*, are connected to the rotatable flange 10 by means of respective pins 38. Each of the slides 19 is, preferably, provided with at least one through hole 22, and the piston 21 is also provided with at least one through hole 23 for the purpose of assisting the smooth flow of a lubricant oil and a working oil. Namely, these holes 22 and 23 enable, on the one hand, the oil to flow smoothly in the apparatus so as to decrease wearing of the components of the apparatus and, on the other hand, enable the piston 21 and the slides 19 to move smoothly.

The piston 21 has at least one axial groove 24 in which is arranged a pin 27 which has the same cross sectional shape as the groove 24 so as to provide a pressure chamber 28 in the groove 24. The pin 27 is rigidly secured to the stationary flange 12 and has an axially extending oil passage 26*b* which is connected at one end to the pressure chamber 28 and the other end to an oil passage 26*a* formed in the stationary flange 12. The oil passage 26*a* is connected to an oil pump 25, which is driven by the engine by means of a conduit 51. The oil passages 26*a* and 26*b* make it possible to easily feed the working oil so as to actuate the piston 21, as will be mentioned hereinafter. Between the stationary flange 12 and the piston 21 is provided an oil reservoir 29 which is connected to an external oil tank 34 by means of an oil passage 30 formed in the stationary flange 12 and a conduit 53 so that oil which has been leaked can be recovered into the tank 34.

Return springs 32 are arranged between and connected to the opposed slides 19 to prevent the slides 19 from separating from each other in radial directions.

In the conduit 51 which is connected to the delivery port (not shown) of the pump 25 is arranged a pressure control valve 37 which is, for example, an electromagnetic valve known per se, so as to control the delivery pressure of the pump 25. The control valve 37 operates in response to an output electrical signal $S_1$ of a microcomputer CPU (mathematical operating apparatus) 31, into which are fed various sensor signals (not shown). For example, signals representing the temperature $T_1$ of the exhaust gas, the number N of revolutions per unit time of the engine, the advance angle $\theta$ of the injection, the ambient temperature $T_2$, and the atmospheric pressure P are input into the CPU 31. Other known factors, such as humidity, relating to the combustion of the engine can be detected by respective sensors known per se and the corresponding detection signals can also be supplied to CPU 31. The numerals 35*a*, 35*b*, 35*c*, and 35*d* all designate oil seals.

The oil pump 25 may be a known gear pump.

FIG. 3 is an enlarged view of the eccentric cam assembly for advancing the initiation of fuel injection when the engine is started. The assembly is shown with the engine not operating. The center point of the rotatable flange 10 and, accordingly, of the hub 16 which rotates about the center point, which will be referred to as a first center point, the center point of the first eccentric cam 33*a*, which will be referred to as a second center point, the center point of the second eccentric cam 33*b*, which will be referred to as a third center point, the center point of the eccentric pin 20, which will be referred to as a fourth center point, and the center point of the pin 38, which will be referred to as fifth center point, are represented by $O_1$, $O_2$, $O_3$, $O_4$, and $O_5$, respectively. When the engine is not operated, the second and fourth center points $O_2$ and $O_4$ are located on one side of a line a connecting the first and third center points $O_1$ and $O_3$, and the fifth center point $O_5$ is located on the other side of the line a. The fifth center point $O_5$ is also located below a line b connecting the second and third center points $O_2$ and $O_3$, that is, it is located on the side on which the first center point $O_1$ is located.

The two eccentric cam assemblies are symmetrical to each other with respect to the first center point $O_1$ in FIG. 3.

In the above-mentioned arrangement of the eccentric cam assemblies, the CPU 31 gives an electrical output signal to the pressure control valve 37 to actuate the latter in accordance with a predetermined program, in the range of the number of revolutions of the engine in which the delivery pressure of the engine-driven pump 25 is high enough to control the injection of fuel. The hydraulic pressure of the pump 25 is adjusted by the valve 37 so as to be constant. The pressurized and regulated oil delivered from the pump 25 is fed to the pressure chamber 28 by means of the conduit 51, the oil passage 26*a* in the stationary flange 12, and the oil passage 26*b* in the pin 27 so that the pressure in the pressure chamber 28 is increased. Due to the increased pressure in the pressure chamber 28, the piston 21 can be axially moved, which movement causes the slides 19 to move radially against the springs 32 by means of the engagement between the inclined surface 21*a* of the piston 21 and the corresponding inclined surfaces 19*a* of the slides 19. On the other hand, the slides 19 are rotated, through the pins 20, by the hub 16, which is, in turn, rotated through the pins 38, by the rotatable flange 10, so that the slides 19 cause radial movements while always rotating on and contacting the piston 21. The outward and radial movements of the slides 19 cause the eccentric cam 33*a* which are supported by the pins 20 and the eccentric cams 33*b* which are supported by the pins 38 to rotate so that a predetermined relative angular displacement, i.e. a predetermined angular phase difference $\theta$, occurs between the rotatable flange 10 on the drive side and the hub 16 on the driven side, with the balance due to the return springs 32 so that the injection of fuel is controlled.

More specifically, when the hydraulic pressure of the oil fed from the pump 25 to the pressure chamber 28 increases, the first eccentric cam 33*a* in FIG. 3 which is connected to the slide 19 by means of the pin 20 begins rotating about its center point $O_2$ in a counterclockwise direction, and at the same time, the center point $O_3$ of the second eccentric cam 33*b* rotates about the center point $O_2$ in a counterclockwise direction. In view of the fact that the distance between the center points $O_1$ and $O_5$, is constant, the pin 38 moves along and on an arc c having a radius connecting $O_1$ and $O_5$ about the center point $O_1$. The pin 38 moves in the direction designated by the arrow A until the center points $O_2$, $O_3$, and $O_5$ come or align in a line, and, after that, the pin 38 moves in a reversed direction designated by the arrow B by a further radial outward movement of the slides 19. Therefore, the angle $\theta$ defined by the line $\overline{O_1O_2}$ and the line $\overline{O_1O_5}$ (i.e. $<O_2O_1O_5$) varies in such a way that it first gradually increases and then decreases in accordance with an increase in the radial outward movement of the slides 19, i.e. an increase in the hydraulic pressure of the working oil acting on the pressure chamber 28. Thus, the advance characteristics of fuel injection as shown in FIG. 4 can be obtained.

Figure 4:
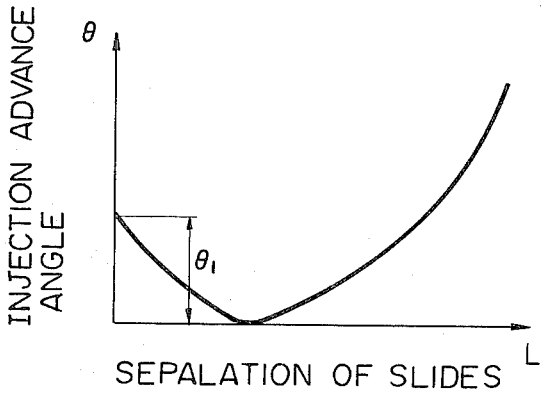
FIG. 4 is a diagram showing the advance characteristics of injection of the fuel, in the present invention.

As can be seen in FIG. 4, when the separation L (FIG. 2) between the two slides 19 increases, fuel injection (advance angle $\theta$) is retarded until the $\theta$ is zero and is then advanced. Therefore, according to the present invention, it is possible to advance the injection of fuel by a value corresponding to $\theta_1$ (FIG. 4) when the engine is started, at which time the pump is not yet operating, without the provision of a spacial pressure source for advancing the injection when the engine is started.

Figure 5:
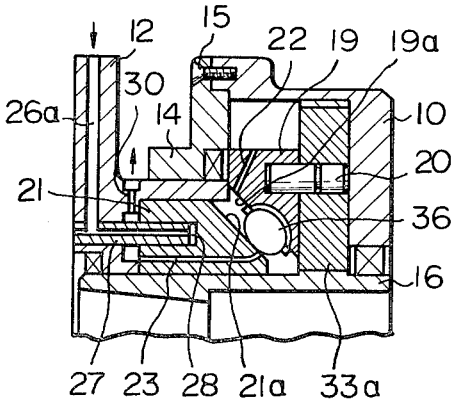
FIGS. 5 and 6 are enlarged partial views of another embodiment of a fuel injection control apparatus, shown in different positions, according to the present invention.
Figure 6:
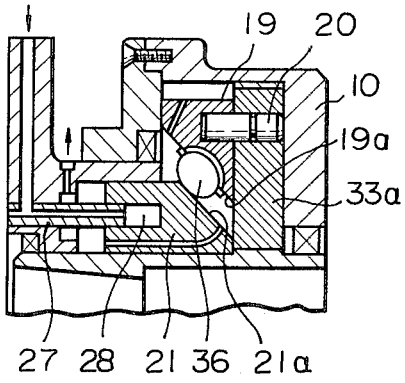

FIGS. 5 and 6 show a modification of FIGS. 1 and 2. In FIGS. 5 and 6, media 36 are additionally provided between the inclined surfaces 19*a* of the slides 19 and the inclined surface 21*a* of the piston 21. The media 36 may be generally spherical or egg-like, or roll-like, or any other rotatable members. Except for the provision of the media 36, the embodiment illustrated in FIGS. 5 and 6 is substantially the same as the embodiment illustrated in FIGS. 1 and 2. This modification makes it possible to convert more smoothly the axial movement of the piston 21 into the radial outward movements of the slides 19 due to the presence of the media 36 which is capable of rolling or rotating, in comparison with FIGS. 1 and 2. In FIG. 3, the piston 21 and the slide 19 are in their initial position. In FIG. 4, the piston 21 and the slide 19 have been moved in axial and radial directions, respectively.

Although the invention has been described in terms of specific embodiments and applications, persons skilled in the art, in light of this teaching, can generate additional embodiments without exceeding the scope or departing from the spirit of the claimed invention. Accordingly, the drawings and descriptions in this disclosure are proffered to facilitate comprehension of the claimed invention and should not be construed to limit the scope thereof.

I claim:

1. A fuel injection advance apparatus in an internal combustion engine with a fuel injection device and an engine-driven pump, comprising a rotational hub which is connected to a cam shaft of the fuel injection device, an engine-driven rotatable casing which is supported on and about the rotational hub so as to rotate relative to the latter, plural eccentric cam assemblies with eccentric pins which are located between the hub and the casing to adjust a relative angular position therebetween in order to control the injection of the fuel of the fuel injection device, a hydraulic piston which is slidably supported on the hub and which is connected to the engine-driven pump, said hydraulic piston being provided, on one end, with an inclined surface, and slides which are capable of radial movement and which have inclined surfaces corresponding to and contacting the inclined surface of the piston so that the axial movement of the piston is converted to the radial movements of the slides by means of the cooperation of the inclined surface of the piston and the inclined surfaces of the slides, said slides being connected to the eccentric pins so that the eccentric cam assemblies can be rotated by the radial movements of the slides.

2. An apparatus according to claim 1 wherein said plural eccentric cam assemblies are arranged symmetrically with respect to the center of the rotational movement of the hub, each of the eccentric cam assemblies further comprising first and second eccentric cams.

3. A fuel injection advance apparatus in an internal combustion engine with a fuel injection device and an engine-driven pump, comprising a rotational hub which is connected to a cam shaft of the fuel injection device, an engine-driven rotatable casing which is supported on and about the rotational hub so as to rotate relative to the latter, a hydraulic piston which is slidably supported on the hub and which is connected to the engine-driven pump, first eccentric cams which are located in the hub in an eccentric arrangement, slides which are connected to the first eccentric cams by means of first pins and which are actuated by the hydraulic piston, and second eccentric cams which are located in the first eccentric cams in an eccentric arrangement and which are connected to the casing by means of second pins, wherein when the engine is stopped the centers of the second pins are located on one side of the lines connected the center of the rotational movement of the hub and the centers of the second eccentric cams, and the centers of the first eccentric cams and the centers of the first pins are located on the opposite side of the lines, respectively, said centers of the second pins being located on the same side of the lines connecting the centers of the first eccentric cams and the centers of the second eccentric cams as the center of the hub is, respectively.

4. An apparatus according to claim 3, wherein said piston and slides have corresponding inclined end surfaces which always come into contact with each other so that the axial movement of the piston is converted to the radial movements of the slides by means of the cooperation of the inclined surface of the piston and the inclined surfaces of the slides.

5. An apparatus according to the claim 1 or 3, further comprising a pressure chamber in the piston, which is connected to the engine-driven pump to actuate the piston.

6. An apparatus according to claim 3, comprising two eccentric cam assemblies which are arranged symmetrically with respect to the center of the rotational movement of the hub, each eccentric cam assembly comprising the first and second eccentric cams.

7. An apparatus according to claim 1 or 4, further comprising media which are located between the inclined surface of the piston and the inclined surfaces of the slides to smoothly convert the axial movement of the piston into the radial movements of the slides.

8. An apparatus according to claim 7, wherein said media are of such a shape that they can roll or rotate between the piston and the slides.

9. A fuel injection advance apparatus in an internal combustion engine with a fuel injection device and an engine-driven pump, comprising a rotational hub which is connected to a cam shaft of the fuel injection device, an engine-driven rotatable casing which is supported on and about the rotational hub so as to rotate relative to the latter, eccentric cam assemblies with eccentric pins which are located between the hub and the casing to adjust a relative angular position therebetween in order to control the injection of the fuel of the fuel injection device, a cylindrical sleeve fixed to said fuel injection device; an annular hydraulic piston slidably disposed in said cylindrical sleeve, said hydraulic piston being coaxial with respect to said rotational hub and provided, on one end, with an inclined surface, and slides which are capable of radial movement and which have inclined surfaces corresponding to and contacting the inclined surface of the piston so that the axial movement of the piston is converted to the radial movements of the slides by means of the cooperation of the inclined surface of the piston and the inclined surfaces of the slides, said slides being connected to the eccentric pins so that the eccentric cam assemblies can be rotated by the radial movements of the slides.

10. A fuel injection advance apparatus in an internal combustion engine with a fuel injection device and an engine-driven pump, comprising a rotational hub which is connected to a cam shaft of the fuel injection device, an engine-driven rotatable casing which is supported on and about the rotational hub so as to rotate relative to the latter, a cylindrical sleeve fixed to said fuel injection device, an annular hydraulic piston slidably disposed in said cylindrical sleeve, said piston being coaxial with respect to said rotational hub, first eccentric cams which are located in the hub in an eccentric arrangement, slides which are connected to the first eccentric cams by means of first pins and which are actuated by the hydraulic piston, and second eccentric cams which are located in the first eccentric cams in an eccentric arrangement and which are connected to the casing by means of second pins, wherein when the engine is stopped the centers of the second pins are located on one side of the lines connecting the center of the rotational movement of the hub and the centers of the second eccentric cams, and the centers of the first eccentric cams and the centers of the first pins are located on the opposite side of the lines, respectively, said centers of the second pins being located on the same side of the lines connecting the centers of the first eccentric cams and the centers of the second eccentric cams as the center of the hub is, respectively.

* * * * *